US005860851A

United States Patent [19]

Beppu et al.

[11] Patent Number: 5,860,851

[45] Date of Patent: Jan. 19, 1999

[54] POLISHING APPARATUS AND POLISHING METHOD USING THE SAME

[75] Inventors: Toshiyasu Beppu, Hyogo; Junji Watanabe, Tokyo, both of Japan

[73] Assignee: Sumitomo Metal Industries, Ltd., Osaka, Japan

[21] Appl. No.: 730,656

[22] Filed: Oct. 11, 1996

Related U.S. Application Data

[63] Continuation of Ser. No. 133,068, filed as PCT/JP93/00173, Feb. 12, 1993, abandoned.

[30] Foreign Application Priority Data

Feb. 12, 1992 [JP] Japan ..... 4-059292
Feb. 10, 1993 [JP] Japan ..... 5-023035

[51] Int. Cl.[6] ..... B24B 7/22

[52] U.S. Cl. ..... 451/41; 451/287; 451/505

[58] Field of Search ..... 451/41, 66, 56, 451/285, 287, 288, 289, 290, 505

[56] References Cited

U.S. PATENT DOCUMENTS

| | | | |
|---|---|---|---|
| 526,137 | 9/1894 | Winslow | 451/505 |
| 3,201,904 | 8/1965 | Evans et al. | 451/289 |
| 4,458,454 | 7/1984 | Barnett | 451/390 |
| 4,979,337 | 12/1990 | Duppstadt | 451/548 |

FOREIGN PATENT DOCUMENTS

| | | | |
|---|---|---|---|
| 465 868 | 1/1992 | European Pat. Off. . | |
| 141285 | 4/1980 | Germany | 451/287 |
| 55-90263 | 7/1980 | Japan . | |
| 63-200966 | 8/1988 | Japan . | |
| 0795667 | 5/1958 | United Kingdom | 451/390 |

*Primary Examiner*—Robert A. Rose
*Attorney, Agent, or Firm*—Burns, Doane, Swecker & Mathis, LLP

[57] ABSTRACT

A polishing apparatus and a polishing method using the apparatus in which an elastic portion is interposed between a polishing table and a polishing cloth, whereby the contacting state between the face of the polishing cloth and a face of a sample to be polished is made uniform and the flatness of the sample is improved. A polishing apparatus and a polishing method using the apparatus in which a second elastic body having on a sample-contacting face resin pellets and/or polishing particles is used in a polishing cloth, whereby the degree of the polishing on a face of a sample to be polished is uniformalized in a macroscopic view point and the flatness is improved in a microscopic view point. A polishing apparatus and a polishing method using the apparatus in which a second elastic body having convex portions, concave portions or groove portions formed on a sample-contacting face is used in a polishing cloth, whereby the degree of the polishing on a face of a sample to be polished is uniformalized in a macroscopic view point and the flatness is improved in a microscopic view point. A polishing apparatus and a polishing method using the apparatus in which an elastic portion is interposed between a polishing table and a polishing cloth, and the second elastic body is used in the polishing cloth.

7 Claims, 10 Drawing Sheets

POLISHING APPARATUS AND POLISHING METHOD USING THE SAME

This application is a continuation of application Ser. No. 08/133,068, filed as PCT/JP93/00173 published as WO93/15878 aband.

FIELD OF THE INVENTION

The invention relates to a polishing apparatus for polishing a large flat substrate such as, particularly, a silicon wafer, a quartz substrate, a glass substrate, a ceramic substrate, a metal substrate, and a wafer under the production process of an LSI.

DESCRIPTION OF RELATED ART

FIG. 1 is a perspective view of a prior art polishing apparatus for polishing a large flat substrate. In the figure, 1 is a disk-like polishing table which can horizontally be rotated by a rotating spindle 6. Onto its surface, a polishing cloth 2 which is made of nonwoven fabric such as polyurethane is stuck by an adhesive 21. A disk-like sample holder 3 which is smaller than the polishing table 1 is located at a position above the polishing cloth 2 and separated therefrom by an adequate distance. The sample holder 3 can horizontally be rotated and moved by a sample holder rotary shaft 5 which is liftable and connected to a driving unit (not shown).

A polishing reagent supply nozzle 7 for ejecting a polishing reagent 8 is fixed at a position which is at the side of the sample holder 3 and above the polishing table 1. A sample B is held to the lower face of the sample holder 3 by an adhesive or a vacuum chuck, and pressingly contacted to the polishing cloth 2 by a polishing load W. While supplying the polishing reagent 8 onto the polishing cloth 2 from the polishing reagent supply nozzle 7, the surface of the sample B is polished by rotating the polishing table 1 and by horizontally rotating and moving the sample holder 3.

Since the polishing cloth 2 is made of nonwoven fabric such as polyurethane, it has a low elastic modulus so as to be easily deformed by a pressure. When a sample is polished by such a polishing apparatus, therefore, the surface of the polishing cloth 2 becomes uneven. To comply with this, an attempt in which a sheet having a thickness of about 0.5 mm is inserted between the polishing cloth 2 and the polishing table 1 has been made. Since the thickness of the polishing cloth 2 is uneven or that of the adhesive 21 is uneven, however, the contacting state between the face of the polishing cloth and the face of the sample to be polished is locally uneven, resulting in a reduced flatness of the face of the sample to be polished. Accordingly, this attempt has been proved not to be effective.

Furthermore, there is a problem in that, since the whole face of the sample to be polished is contacted with the face of the polishing cloth, the periphery portion of the sample is more easily polished than the inner periphery portion and therefore the face of the sample to be polished cannot uniformly be polished. In the case where the load W applied to the sample B is increased so that the contacting state between the face of the polishing cloth and the face of the sample to be polished is uniformalized, there arises a problem in that scratches (scratched portions) are formed on the face to be polished or a polishing distortion is developed, whereby the original properties of the sample are damaged.

When wiring patterns are formed on a wafer substrate in a production process of an LSI and an insulating film is formed to cover the entire surface of the wafer, the surface of the insulating film becomes irregular in accordance with the existence or nonexistence of the wiring patterns. In the case where the insulating film of such a wafer is to be polished, the polishing must be conducted in a macroscopic view point so that the thickness of the insulating film becomes uniform, and in a microscopic view point so that the surface becomes flat. When a soft polishing cloth is used in a prior art polishing apparatus, the elastic deformation of the polishing cloth causes the polishing cloth to deform along the irregularity of the surface of the insulating film, and thus the polishing is done on not only convex portions but also concave portions.

FIG. 2 is a diagrammatic section view showing the contacting state between a soft polishing cloth and a wafer. Wirings 84, 84 . . . are formed on a wafer substrate 81, and covered by an insulating film 83. In the case where the surface of such a wafer is to be polished, a soft polishing cloth 82 elastically deforms so as to contact to and polish even concaved portions of the wafer surface, thereby requiring a prolonged time period for making the wafer surface flat (making the level difference of the irregularities zero). Therefore, it is required to increase the thickness of the insulating film as compared with a usual case. Practically, however, there is a limit to increase the thickness of an insulating film, and it is impossible to make the wafer surface completely flat. This produces a problem in that the flatness is low in a microscopic view point.

As a counter measure, a technique in which a very hard polishing cloth may be used in place of a soft polishing cloth may be employed. FIG. 3 is a diagrammatic section view showing the contacting state between a very hard polishing cloth and a wafer. Wirings (not shown) are formed on a wafer substrate 81, and covered by an insulating film 83. In the case where the surface of such a wafer is to be polished, since a very hard polishing cloth 82 has a very high elastic modulus, the polishing cloth contacts to portions which are convex ones in a macroscopic view point, irrespective of the flatness of the wafer surface, and polishes only the contacting portions. Accordingly, the technique has a problem in that the insulating film 83 cannot be polished to a uniform thickness in a macroscopic view point.

It is an object of the invention to uniformalize a contacting state between a face of a polishing cloth and a face of a sample to be polished, thereby improving a uniform polishing and flatness of the sample, and to provide a polishing apparatus and a polishing method using it in which a load applied to the sample is reduced, the smoothness of the sample is improved, and a polishing distortion is reduced.

It is another object of the invention to provide a polishing apparatus and a polishing method using it in which, in a macroscopic view point, a uniform polishing is conducted along a surface of a sample, and, in a microscopic view point, the flatness is improved.

SUMMARY OF THE INVENTION

In a polishing apparatus of the invention and a polishing method using the apparatus, an elastic portion is interposed between a polishing table and a polishing cloth. As the elastic portion, an annular disk-like elastic body is interposed so that a face of the polishing cloth contacts a small area of a face of a sample to be polished. This allows the contacting state between the face of the polishing cloth and the face of the sample to be polished to become uniform. Therefore, a polishing is conducted without causing the face of the polishing cloth to apply an excessive load to the periphery portion of the sample.

In another polishing apparatus of the invention and a polishing method using the apparatus, a disk-like elastic body one face of which is spherical is interposed in place of the annular disk-like elastic body. Accordingly, the center portion of the spherical face of the polishing cloth contacts to a face of a sample to be polished, so that the face of the polishing cloth does not apply an excessive load to the periphery portion of the sample, thereby allowing the contacting state between the face of the polishing cloth and the face of the sample to be polished to become uniform.

In a further polishing apparatus of the invention and a polishing method using the apparatus, similarly, a fluid encapsulating portion into which a fluid is encapsulated is interposed between a disk-like polishing table and a polishing cloth covering the polishing table. Accordingly, the fluid encapsulating portion has a disk-like shape one face of which is spherical, and only the center portion of the face of the polishing cloth contacts a face to be polished of a sample, so that the face of the polishing cloth does not apply an excessive load to the periphery portion of the sample, thereby allowing the contacting state between the face of the polishing cloth and the face of the sample to be polished to become uniform. Furthermore, the pressure in the fluid in the fluid encapsulating portion can be controlled so that the polishing is conducted with a contacting state corresponding to the sample.

In a still further polishing apparatus of the invention and a polishing method using the apparatus, a sample-contacting face of a polishing cloth is structured so that resin pellets and/or polishing particles are embedded or attached to a second elastic body. Therefore, the surface of the polishing cloth can deform in accordance with the flatness of a sample in a macroscopic view point so that the surface of the sample is uniformly polished, and convex portions in a microscopic view point of the sample are polished, thereby improving the flatness.

In a still further polishing apparatus of the invention and a polishing method using the apparatus, a sample-contacting face of a polishing cloth is structured so that convex portions, concave portions or groove portions are formed in a second elastic body. Therefore, the surface of the polishing cloth can deform in accordance with the flatness of a sample in a macroscopic view point so that convex portions in a microscopic view point of the sample are selectively polished.

In a still further polishing apparatus of the invention and a polishing method using the apparatus, the above-mentioned elastic portion is interposed, and a sample-contacting face of a polishing cloth is structured so that resin pellets and/or polishing particles are embedded or attached to a second elastic body, or that convex portions, concave portions or groove portions are formed in the second elastic body. Therefore, the contact between the face of the sample to be polished and the polishing cloth becomes uniform, the surface of the sample is uniformly polished in a macroscopic view point, and convex portions are selectively polished in a microscopic view point, thereby improving the flatness.

DESCRIPTION OF THE PREFERRED EMBODIMENTS

(First Embodiment)

Figure 1:
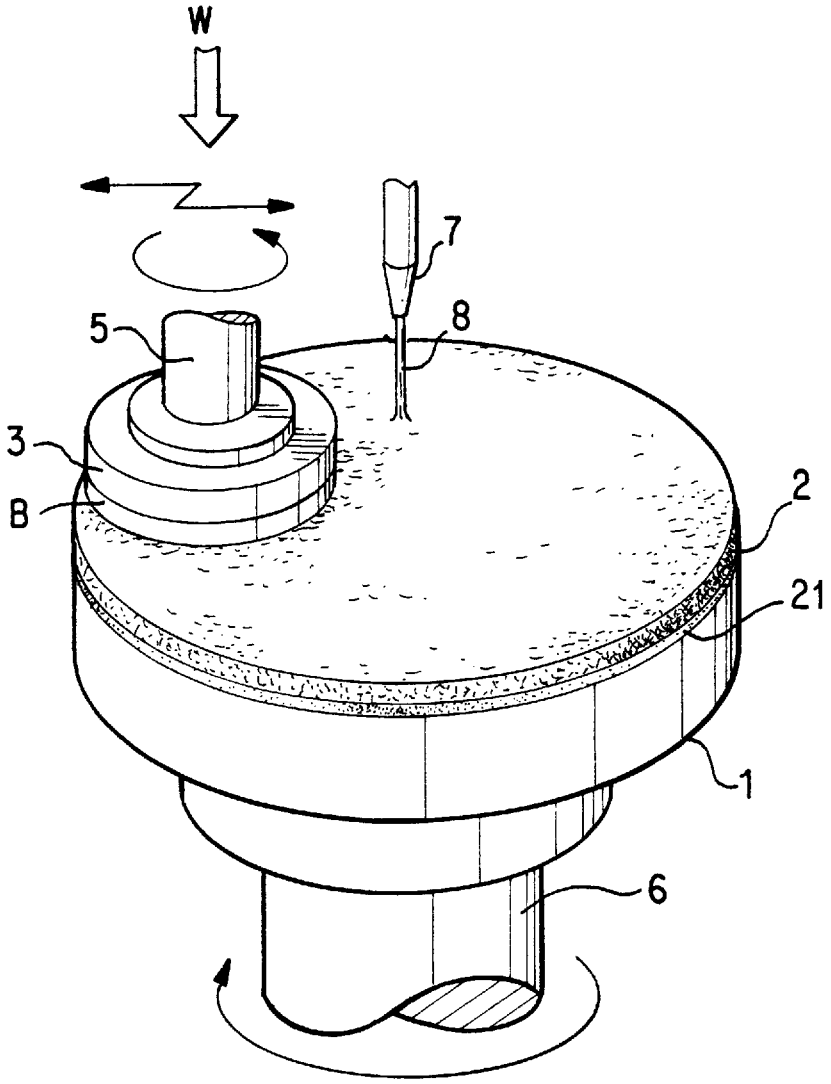
Fig. 1 PRIOR ART
FIG. 1 is a perspective view showing the configuration of a prior art polishing apparatus.
Figure 2:
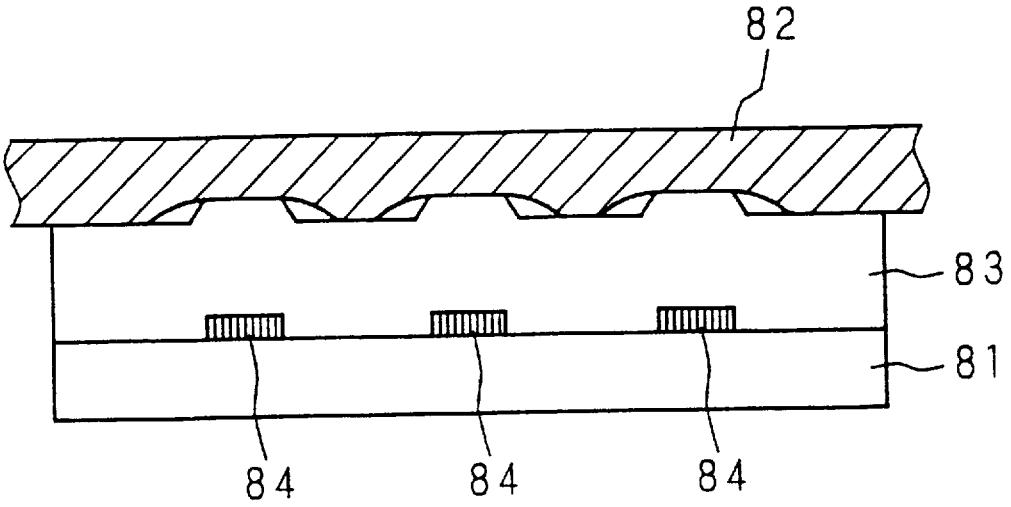
Fig. 2 Prior Art
FIG. 2 is a diagrammatic section view showing one portion of the prior art polishing apparatus.
Figure 3:
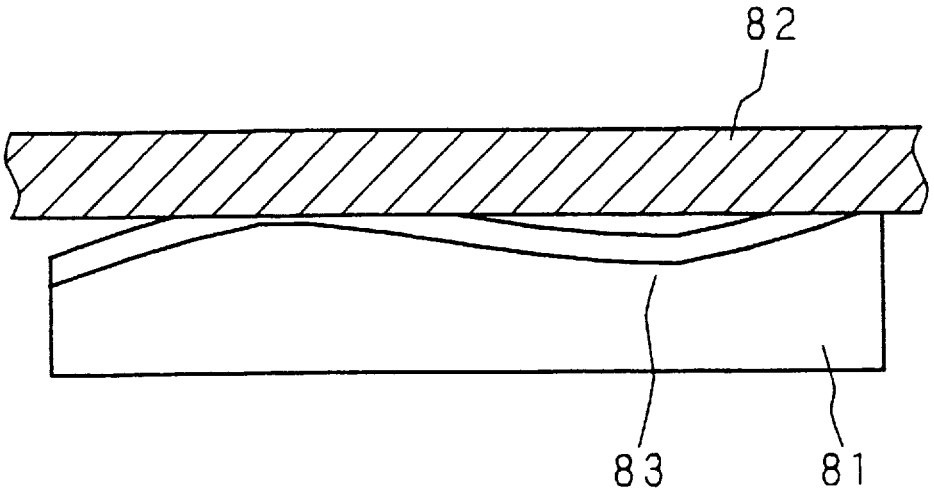
Fig. 3 Prior Art
FIG. 3 is a diagrammatic section view showing one portion of the prior art polishing apparatus.
Figure 4:
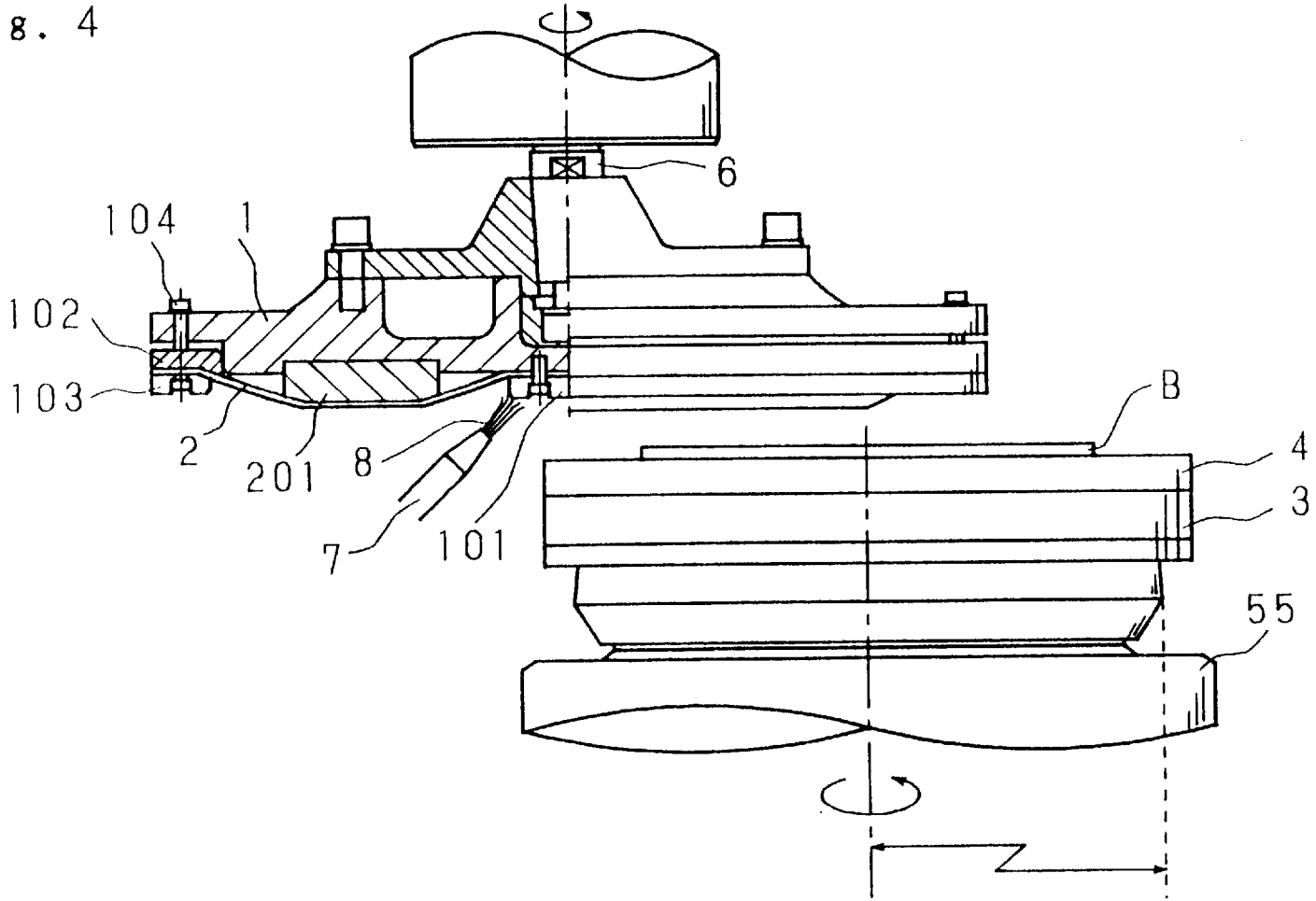
FIG. 4 is a front view showing, partly in section, a polishing apparatus which is a first embodiment of the invention.

Hereinafter, the invention will be described with reference to the drawings showing its first embodiment. FIG. 4 is a front view showing, partly in section, a polishing apparatus of the invention.

In the figure, 1 is a disk-like polishing table, and 3 is a disk-like sample holder. The center of the upper face of the polishing table 1 is connected to a lower end portion of a rotating spindle 6 so as to be horizontally rotatable.

Below the polishing table 1, disposed is the sample holder 3 mounted on a spindle 55 which can horizontally be rotated and moved. The spindle 55 is located at a position which is eccentric with respect to the polishing table 1. The rotation center of the spindle 55 can horizontally move in the direction from the periphery portion of a polishing cloth 2 and opposite to the center of the polishing table 1, by a distance which is approximately equal to the radius of a sample B.

On the lower face of the polishing table 1, a concentric peripheral groove is formed. Into the peripheral groove, an annular disk-like elastic body 201 having a thickness which is greater than the depth of the groove is fitted so as to protrude from the polishing table 1. On the lower face of the outer edge of the polishing table 1, formed is a step portion into which a fixing ring 102 is fitted. The periphery portion of the polishing cloth 2 is sandwiched by fixing rings 102, 103, 103, . . . and the center portion of the polishing cloth covers the lower face of the elastic body 201. The outer edge of the polishing table 1 is fixed by the fixing rings 102, 103 and bolts 104, 104 . . . which pass through the polishing table 1. The tension of the polishing cloth 2 can be adjusted by bolts 104, 104 . . . .

The center portion of the polishing cloth 2 is fixed to the polishing table 1 by a fixing plate 101 thinner than the thickness of the portion of the elastic body 201 a portion of which protrudes from the polishing table, in such a manner that a recess is formed. A polishing reagent supply nozzle 7 for ejecting a polishing reagent 8 is disposed in the vicinity of the center of the polishing cloth 2.

Hereinafter, an example of specific conditions of conducting a polishing using this apparatus will be described.

As the sample B, a large size silicon wafer having a diameter of 8 inches is fixed onto the sample holder 3 by a vacuum chuck 4. As the elastic body 201, chloroprene rubber (thickness: about 15 mm to 20 mm, $H_S$=65, and tensile strength: 80 kg/cm 2) is used, and, as the polishing cloth 2, a mixture body of polyurethane resin and fibers is used. The tension is adjusted to a value at which the elastic body 201 deforms by about 0.1 mm. First, while the polishing reagent 8 in which ultrafine particles of $SiO_2$ (average particle diameter: 0.1 μm to 0.2 μm) are suspended in a weak alkaline (from pH 10 to pH 12) liquid is supplied at 3 liters/min. to the face to be polished, the polishing table 1 is rotated at 2000 rpm, and the sample holder 3 onto which the sample B is mounted is rotated at 200 rpm.

Then, the sample holder 3 is moved to a position where the periphery portion of the polishing cloth 2 is perpendicularly above the rotation center of the sample holder. The polishing table 1 is lowered to a position where the polishing cloth 2 contacts the sample B. The contacting position is determined by detecting the output load of the motor for the rotating spindle 6 by which the polishing table 1 is rotated.

The polishing table 1 is further pressingly lowered from the contacting position to a position where the elastic body 201 deforms by about 0.3 mm. The sample holder 3 on which the sample B is mounted is horizontally oscillated in the direction opposite to the center of the polishing table 1, by a distance which is approximately equal to the radius of the sample B, and the sample B is polished. In this polishing, the sample B can be uniformly polished.

When a polishing is conducted while the rotating spindle 6 for rotating the polishing table 1 is tilted by several deg. with respect to the perpendicular direction, the periphery portion of the sample B can be more uniformly polished.

Unlike the above-described method, a polishing may be conducted without pressingly lowering the polishing table 1 after the polishing table 1 contacts to the surface of the sample B. In this case, the rotation of the polishing table 1 and the sample holder 3 causes a water film of the polishing reagent 8 to be formed on the surface of the sample B. The elastic body 201 is deformed by the pressure of the water film so that a gap of several μm is formed between the face of the sample B to be polished and the surface of the polishing cloth 2. The presence of the gap allows a polishing to be conducted under a state where the face of the sample B to be polished is not contacted with the polishing cloth 2 or under that similar to the state. This method can more uniformly polish the face of the sample B to be polished than the above-described method.

Figure 5:
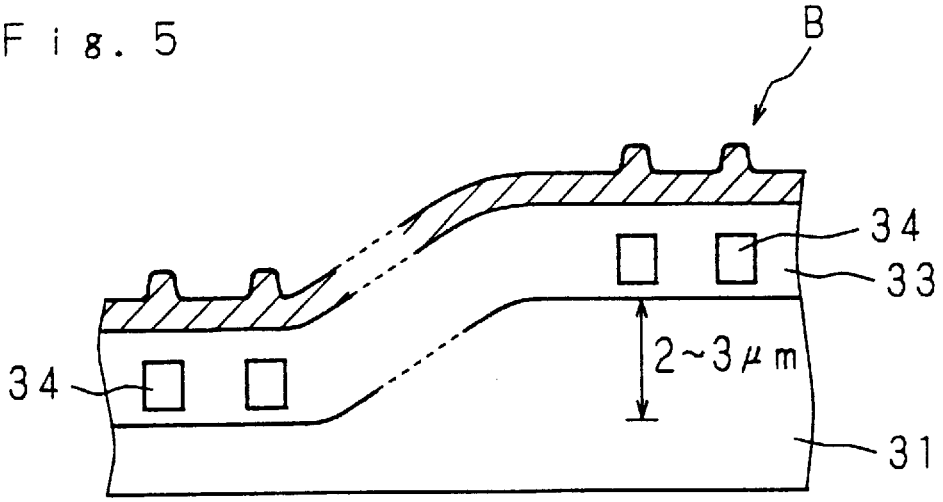
FIG. 5 is a diagrammatic section view showing one portion of a sample to be polished.

A method of conducting a polishing with using the above-described apparatus and in the case where the sample B is a wafer having a silicon wafer substrate on which wirings and an insulating film are previously formed will be described. FIG. 5 is a diagrammatic section view showing the configuration of the sample B. A large size silicon wafer substrate 31 of a diameter of 8 inches has a flatness of 2 to 3 μm, and wirings 34, 34 . . . are formed on the substrate. An insulating film 33 is deposited so as to cover the wirings. The film thickness distribution of the insulating film 33 is about 10%, and the flatness of the sample B is 3 to 4 μm. The sample B is fixed onto the sample holder 3 by the vacuum chuck 4. As the elastic body 201, silicone rubber (thickness: about 15 mm to 20 mm, $H_S$=55, and tensile strength: 80 kg/cm$^2$) is used, and, as the polishing cloth 2, a mixture body of polyurethane resin and fibers is used. The tension is adjusted to a value at which the elastic body 201 deforms by about 0.1 mm. The thickness of the polishing cloth 2 is not greater than 0.8 mm, and, if possible, not greater than 0.5 mm. First, while the polishing reagent 8 in which ultrafine particles of $SiO_2$ (average particle diameter: 0.1 μm to 0.2 μm) are suspended in a weak alkaline (from pH 10 to pH 12) liquid is supplied at 3 liters/min. to the face to be polished, the polishing table 1 is rotated at 2000 rpm, and the sample holder 3 onto which the sample B is mounted is rotated at 200 rpm.

Since the polishing cloth 2 is hard and has a thickness equal to or less than 0.8 mm, the polishing cloth 2 and the elastic body 201 deform along irregularities in a macroscopic view point of the contacting face of the sample B, and the polishing cloth 2 does not deform along irregularities in a microscopic view point of the contacting face of the sample B. Therefore, a microscopic flattening can be efficiently conducted on the whole surface of the sample B.

In a case where the polishing cloth 2 is made of a soft material such as sponge of chloroprene, the thickness of the polishing cloth 2 is preferably set so that the change in the pressure of the polishing table 1 is not greater than 20% with respect to the change of 3 to 4 μm in the deformation of the elastic body 201.

The polishing cloth 2 may be of a material other than those described in the above embodiment, namely, a sheet of Teflon, nonwoven fabric, expanded polyurethane resin, resin including particles of an oxide such as selenium oxide or diamond particles, or the like.

(Second Embodiment)

Figure 6:
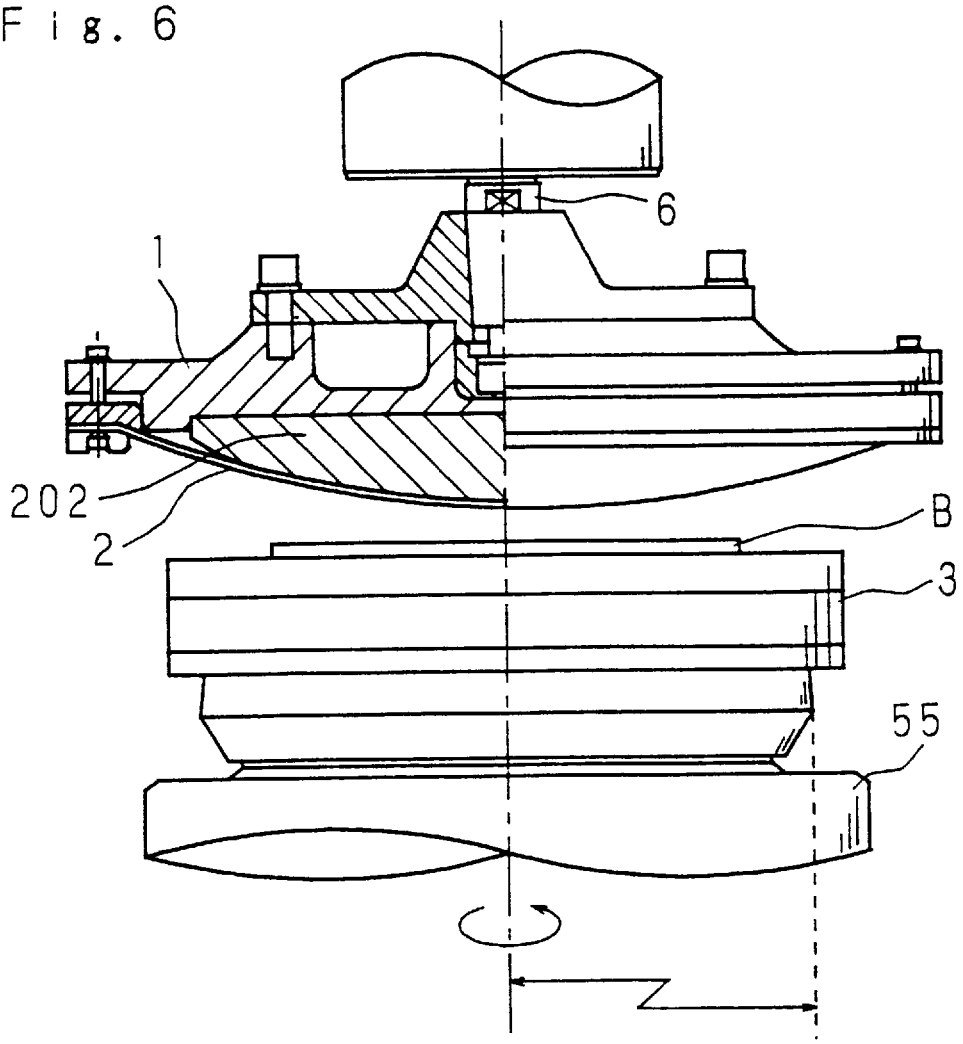
FIG. 6 is a front view showing, partly in section, a polishing apparatus which is a second embodiment of the invention.

FIG. 6 is a front view showing, partly in section, a second embodiment of the invention. A polishing table 1 is connected at the center of the upper face to a lower end portion of a rotating spindle 6 so as to be horizontally rotatable. Below the polishing table 1, disposed is a sample holder 3 mounted on a spindle 55 which can horizontally be rotated and moved. The spindle 55 is located at a position which is concentric with respect to the polishing table 1, and can horizontally move in the direction from the center of a polishing cloth 2 toward the periphery direction, by a distance which is approximately equal to the radius of a sample.

On the lower face of the polishing table 1, a recess having a concentric circular shape is formed. Into the recess, a disk-like elastic body 202 one face of which is spherical is fitted. The thickness of the periphery portion of the elastic body is greater than the depth of the recess so that the elastic body 202 protrudes from the polishing table 1.

In the same manner as the first embodiment, a polishing cloth 2 is fixed so as to cover the elastic body 202. When a polishing is to be conducted using this apparatus, a sample B is firstly mounted on the sample holder 3. Then, the sample holder 3 is horizontally moved in the direction from the center of the polishing table 1 toward the periphery portion of the polishing table 1, by a distance which is approximately equal to the radius of the sample B, and the sample B is polished. In this polishing, the face of the sample B to be polished can be uniformly polished. When a polishing is conducted while the rotating spindle 6 for rotating the polishing table 1 is tilted by several deg. with respect to the perpendicular direction, it is possible to prevent the polishing cloth 2 from gathering to the point at which it contacts the sample B, thereby improving the abrasive resistance of the polishing cloth 2.

(Third Embodiment)

Figure 7:
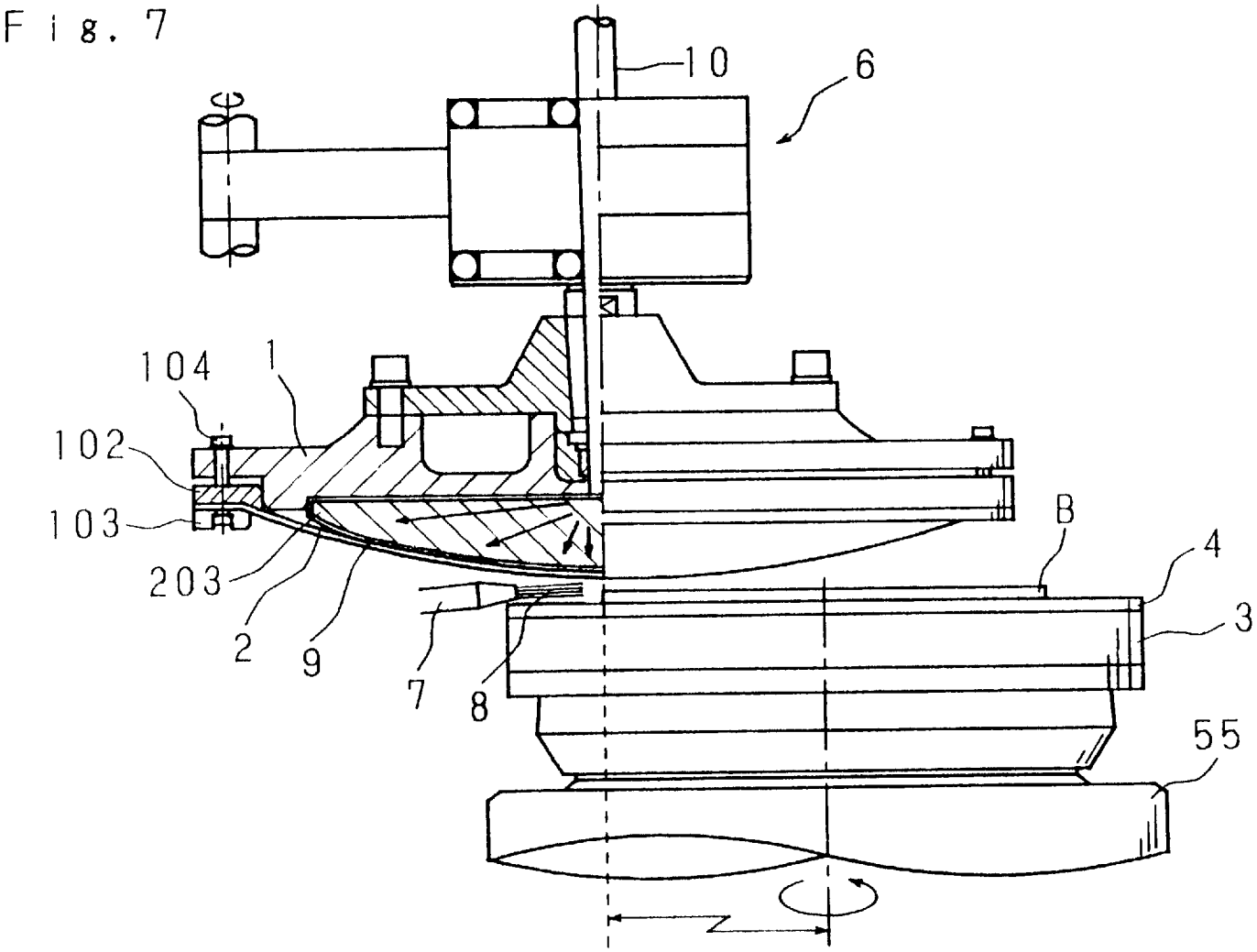
FIG. 7 is a front view showing, partly in section, a polishing apparatus which is a third embodiment of the invention.

FIG. 7 is a front view showing, partly in section, a third embodiment of the invention.

In the figure, 1 is a disk-like polishing table which is connected at the center of the upper face to a lower end portion of a rotating spindle 6 so as to be horizontally rotatable. Below the polishing table 1, disposed is a disk-like sample holder 3 for mounting a sample and mounted on a spindle 55 which can horizontally be rotated and moved. The spindle 55 is located at a position which is concentric with the polishing table 1. The rotation center of the spindle 55 can horizontally move in the direction from the center of a polishing cloth 2 toward the periphery portion, by at least a distance equal to the radius of the sample.

On the lower face of the polishing table 1, a recess having a concentric circular shape is formed. In the same manner as the first embodiment, the periphery portion of the polishing cloth 2 is fixed to the lower portion of the polishing table 1 by fixing rings 102, 103, 103, . . . and bolts 104, 104 . . . An encapsulating bag 9 is loosely inserted between the polishing table 1 and the polishing cloth 2. A supply duct 10 for supplying a liquid 203 to the encapsulating bag 9 passes through the center portion of the rotating spindle 6, and is attached to the center portion of the upper face of the encapsulating bag 9.

The liquid 203 is poured through the supply duct 10 into the encapsulating bag 9, so that the fluid encapsulating portion having a spherical shape is formed between the polishing table 1 and the polishing cloth 2. A polishing reagent supply nozzle 7 for ejecting a polishing reagent 8 is disposed in the vicinity of the center of the polishing cloth 2. When a polishing is to be conducted using this apparatus, a sample B is firstly mounted on the sample holder 3. Then, using a constant-pressure pump (not shown), the liquid 203 is poured through the supply duct 10 into the encapsulating bag 9, whereby the pressure of the liquid 203 in the encapsulating bag 9 can be adjusted. At this time, the shape of the fluid encapsulating portion causes the lower face of the polishing cloth 2 to become substantially spherical.

Then, the sample holder 3 is moved to a position where the rotary shaft of the sample holder 3 and that of the polishing table 1 are on the same perpendicular line, and their rotations are started to conduct a polishing. In this way, positions of the face of the sample B to be polished are pressed by a substantially constant pressure, and hence can be uniformly polished. A polishing may be conducted while fixing the sample holder 3 at a position where the polishing table 1 and the rotary shaft are coincident as described above. Alternatively, a polishing may be conducted while moving the sample holder 3 in a radial direction of the sample.

In the embodiment, a liquid is encapsulated into the encapsulating bag 9. Alternatively, in place of a liquid, a gas may be encapsulated into the encapsulating bag.

(Fourth Embodiment)

Figure 8A:
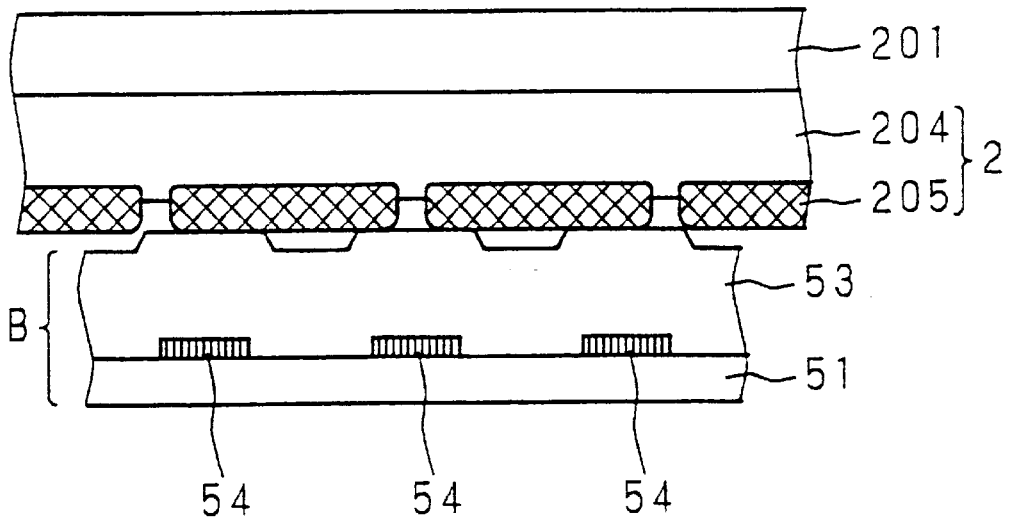
FIG. 8 is a diagrammatic section view showing one portion of a polishing apparatus which is a fourth embodiment of the invention.
Figure 8B:
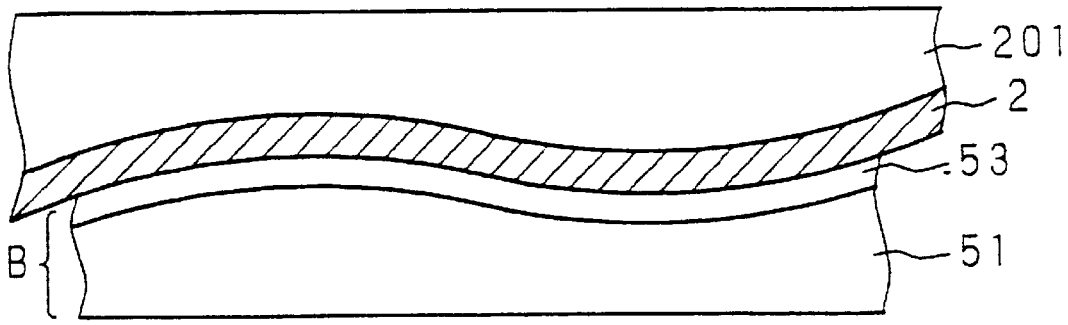

FIG. 8 is a diagrammatic section view showing one portion of a polishing apparatus which is a fourth embodiment of the invention. More specifically, FIG. 8 is a section view showing on an enlarged scale the polishing cloth 2, the annular disk-like elastic body 201 and the sample B of the polishing apparatus of FIG. 4 which is the first embodiment described above. As shown in FIG. 8(*a*), the polishing cloth 2 has a configuration where resin pellets 205, 205 . . . are embedded in a surface of a second elastic body 204 such as flexible urethane rubber a surface of which contacts the sample B. The elastic body 201 made of chloroprene rubber is interposed between the polishing cloth 2 and the polishing table 1 (FIG. 4). As the resin pellets 205, 205 . . . , pellets made of polyvinyl chloride or polyethylene and having a spherical shape of a diameter of 0.3 mm are used. The sample B has a configuration where wirings 54, 54 . . . and an insulating film 53 are formed on a silicon wafer 51. When a polishing similar to that of the first embodiment described above is conducted, the insulating film 53 on the surface is polished. The surface of the sample B is irregular because of the wirings 54, 54 of the polishing cloth 2 selectively polish convex portions of the insulating film 53, and do not contact concave portions. This improves the flatness of the sample B in a microscopic view point.

FIG. 8(*b*) is a diagrammatic section view showing in a macroscopic view point the polishing cloth 2, the annular disk-like elastic body 201 and the sample B shown in FIG. 8(*a*). The resin pellets 205, 205 . . . and the wirings 54, 54 . . . are omitted. When the surface of the sample B is polished, the second elastic body 204 of the polishing cloth 2 elastically deforms so that the shape of the polishing cloth 2 deforms along the shape of the surface of the sample B in a macroscopic view point, whereby the degree of the polishing on the surface of the sample B is uniformalized.

Preferably, the resin pellets are harder than the second elastic body, and spherical pellets made of polyvinyl chloride or polyethylene and having a diameter of 0.3 mm are used. The invention is not restricted to this. The resin pellets may be those in which polyvinyl chloride, polyethylene or the like contains particles such as $Al_2O_3$, $CeO_2$ or diamond of a particle diameter of 1.0 $\mu$m or less.

In the fourth embodiment described above, the resin pellets 205, 205 . . . of the polishing cloth 2 are embedded in the surface of the second elastic body 204 in the side of the sample B. Alternatively, the resin pellets may be fixed and attached to an adhesive face formed on a surface of, for example, the second elastic body 204 in the side of the sample B.

(Fifth Embodiment)

Figure 9:
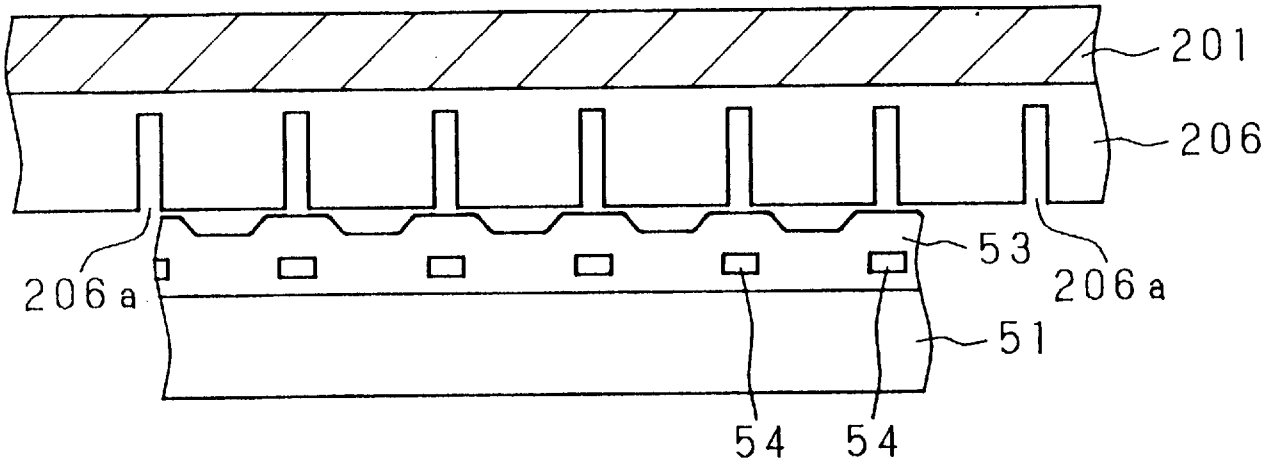
FIG. 9 a diagrammatic section view showing one portion of a polishing apparatus which is a fifth embodiment of the invention.

Next, FIG. 9 is a diagrammatic section view showing one portion of a polishing apparatus which is a fifth embodiment of the invention. More specifically, FIG. 9 is a section view showing on an enlarged scale the polishing cloth 2, the annular disk-like elastic body 201 and the sample B of the polishing apparatus of FIG. 4 which is the first embodiment described above. As shown in FIG. 9, the polishing cloth 2 has a configuration where concave portions 206*a*, 206*a* . . . are formed in the side of a second elastic body 206 which contacts to the sample B. The second elastic body 206 is a pad of a thickness of 1.5 mm which may be formed by, for example, impregnating urethane rubber into nonwoven fabric and hardening it. Therein the concave portions 206*a*, 206*a* 1.4 mm are arranged at a pitch of 1.5 mm. The sample B has a configuration where wirings 54, 54 . . . and an insulating film 53 are formed on a silicon wafer 51. While a polishing reagent 8 in which ultrafine particles of $SiO_2$ (average particle diameter: about 0.05 $\mu$m to 0.2 $\mu$m) are suspended in a weak alkaline (from pH 10 to pH 12) liquid is supplied at 3 liters/min. to the face to be polished, a polishing table 1 is rotated at 2000 rpm, and a sample holder 3 onto which the sample B is mounted is rotated at 200 rpm. Then, a polishing is conducted in the same manner as the above-described first embodiment. In this case, since the second elastic body 206 of the polishing cloth 2 is hard, it does not follow microscopic irregularities, and therefore the flatness of the sample B in a microscopic view point is improved. Since the concave portions 206*a*, 206*a* . . . of the polishing cloth 2 are formed, the shape of the polishing cloth 2 deforms along the shape of the surface of the sample B, whereby the degree of the polishing on the surface of the sample B is uniformalized in a macroscopic view point.

The openings of the concave portions formed in the second elastic body 206 of the polishing cloth 2 used in embodiment 5 described above have the size of 0.1 mm×0.1 mm. The invention is not restricted to this. The concave portions may be groove-like ones. Alternatively, convex portions may be formed in the surface of the second elastic body 206 in the side of the sample B.

Figure 10:
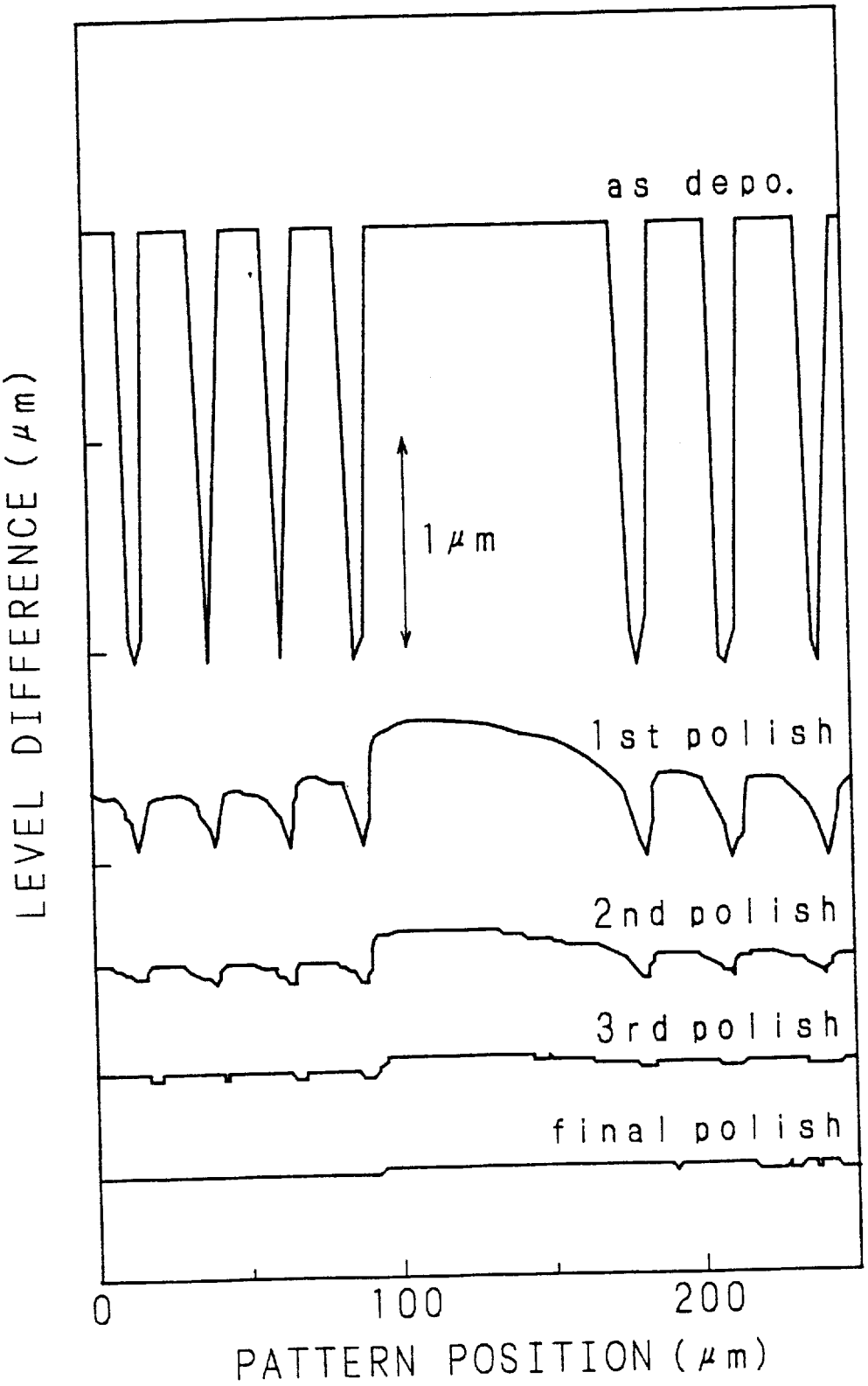
FIG. 10 is a graph showing level differences which were measured each time when a surface of a sample was polished by the polishing apparatus of the fourth embodiment.

Next, results are shown that were obtained by polishing a wafer on which an $SiO_2$ film was deposited, using the above-described apparatus of the fourth embodiment, and measuring the flatness. FIG. 10 is a graph showing level differences measured each time when a surface of a sample was polished by the polishing apparatus one portion of which is shown in FIG. 8(*a*). The ordinate indicates the level difference of the surface, and the abscissa indicates the position (size) of wiring patterns. As apparent from the graph, it will be noted that the level difference of about 2 $\mu$m before a polishing is decreased to 0.5 $\mu$m with the increase of the number of polishing processes, and the flatness is improved.

INDUSTRIAL APPLICABILITY

As described above, according to the invention, an annular disk-like elastic body, a disk-like elastic body one face of which is spherical, or a fluid is interposed between a polishing table and a polishing cloth. Therefore, the contacting state between the face of the polishing cloth and a face of a sample to be polished becomes uniform, so that the flatness of the sample can be improved. Moreover, since the pressure of the fluid can be controlled, the invention has an effect that the pressing force of the face of the polishing cloth against the face of the sample to be polished can easily be controlled.

Furthermore, according to the invention, a gap is formed between the face of the polishing cloth and a face of a sample to be polished, and a polishing is conducted while supplying a polishing reagent into the gap. Therefore, the invention has effects that a load applied to the sample is reduced, that the smoothness of the sample is improved, and that a polishing distortion is reduced.

Furthermore, according to the invention, the polishing cloth is provided with a second elastic body, and resin pellets and/or polishing particles are embedded or attached to the sample-contacting face of the elastic body. Therefore, a sample can be polished so as to have a thickness which is uniform in a macroscopic view point, and the flatness in a microscopic view point of the face of the sample to be polished can be improved. Moreover, the use of the polishing cloth of a second elastic body in which convex portions, concave portions or groove portions are formed on the sample-contacting face provides effects that a sample can be polished so as to have a thickness which is uniform in a macroscopic view point, and that the flatness in a microscopic view point of the face of the sample to be polished can be improved.

Furthermore, according to the invention, an elastic portion is interposed between a polishing table and a polishing cloth, and further the polishing cloth is provided with a second elastic body, thereby attaining an effect that the flatness of a sample can be further improved.

We claim:

1. A polishing apparatus, comprising:

a rotatable sample holder for holding a substrate which has a rugged surface;

a rotatable polishing table;

a polishing cloth fixed to said polishing table so that only a peripheral portion of said polishing cloth is fixed to said polishing table so that the tensile strength of the polishing cloth is adjustable, said polishing cloth having two oppositely facing exposed surfaces, one of said exposed surfaces being a substrate contacting surface for contacting the substrate held on said sample holder;

means for supplying a polishing reagent between said polishing cloth and a substrate which is held on said sample holder; and an elastic member interposed between said polishing table and said polishing cloth, with said polishing cloth being movable independent of the elastic member.

2. A polishing method for polishing a substrate using the polishing apparatus according to claim 1, comprising:

chucking a substrate having a rugged surface on a sample holder;

adjusting a tensile strength of a polishing cloth whose peripheral portion is fixed to a polishing table to a desired tension;

supplying a polishing reagent between said substrate and said polishing cloth;

lowering said polishing table so that said polishing cloth contacts said substrate with a desired pressure; and polishing said substrate while rotating said polishing table and said sample holder independently.

3. A polishing apparatus according to claim 1, wherein said polishing cloth is fixed to said polishing table by at least one fixing ring and a bolt, the tensile strength of said polishing cloth being adjusted by fastening said bolt.

4. A polishing method using a polishing apparatus according to claim 3, comprising steps of:

chucking a substrate having a rugged surface on a sample holder;

adjusting a tensile strength of a polishing cloth whose peripheral portion is fixed to a polishing table to a desired tension by adjusting a degree of fastening of said plural bolts;

supplying a polishing reagent between said substrate and said polishing cloth;

lowering said polishing table so that said polishing cloth contacts said substrate with a desired pressure; and polishing said substrate while rotating said polishing table and said sample holder independently.

5. A polishing apparatus according to claim 1, wherein the elastic member is a first elastic member, and wherein the polishing cloth includes a second elastic member.

6. A polishing apparatus, comprising:

a rotatable sample holder for holding a substrate which has a rugged surface;

a rotatable polishing table;

a polishing cloth fixed to said polishing table so that a peripheral portion of said polishing cloth is fixed to said polishing table to permit adjustment of tension in the polishing cloth, said polishing cloth having first and second oppositely facing exposed surfaces, the first exposed surface being a substrate contacting surface for contacting the substrate held on the sample holder;

means for supplying a polishing reagent between the polishing cloth and a substrate which is held on said sample holder; and an elastic member interposed between said polishing table and said polishing cloth, one portion of said second exposed surface of said polishing cloth being in contact with said elastic member with portions of said second exposed surface located radially outwardly and radially inwardly of said one portion being free of contact with said elastic member and spaced from the polishing table.

7. A polishing method for polishing a substrate through use of a polishing apparatus that includes a polishing table, a polishing cloth fixed to said polishing table so that a peripheral portion of said polishing cloth is fixed to said polishing table, and an elastic member interposed between said polishing table and said polishing cloth, said polishing cloth having first and second oppositely facing exposed surfaces, one portion of said second exposed surface of said polishing cloth being in contact with said elastic member, the method comprising:

chucking a substrate having a rugged surface on a sample holder;

adjusting tension in the polishing cloth to a desired tension with said polishing cloth being movable relative to said elastic member;

supplying a polishing reagent between said substrate and said first exposed surface of said polishing cloth;

lowering said polishing table so that said first exposed surface of said polishing cloth contacts said substrate with a desired pressure; and polishing said substrate while rotating said polishing table and said sample holder independently.

* * * * *